United States Patent [19]

Hatta et al.

[11] 3,959,930

[45] June 1, 1976

[54] APPARATUS FOR CUTTING OFF CAST PARTS FROM A RUNNER OF A CASTING BODY

[75] Inventors: Masami Hatta; Tetsusi Ohkawa, both of Yasugi, Japan

[73] Assignee: Hitachi Metals, Ltd., Japan

[22] Filed: Oct. 23, 1974

[21] Appl. No.: 517,377

[30] Foreign Application Priority Data

Oct. 24, 1973 Japan ..... 48-118988

[52] U.S. Cl. ..... 51/92 ND; 51/95 WH; 51/99; 51/165.87

[51] Int. Cl.[2] ..... B24B 19/00; B24B 23/08

[58] Field of Search ..... 51/92 R, 92 ND, 95 R, 51/95 WH, 99, 103 C, 165.87, 216 ND; 83/704, 708, 410, 411; 144/2 R

[56] References Cited

UNITED STATES PATENTS

| | | | |
|---|---|---|---|
| 1,032,686 | 7/1912 | Kundig | 51/165.87 |
| 2,292,588 | 8/1942 | Terbrueggen | 51/92 ND |
| 2,296,731 | 9/1942 | Mustonen | 51/92 ND |
| 2,426,807 | 9/1947 | Wilson | 51/92 ND |
| 2,467,674 | 4/1949 | Krueger | 51/92 R |
| 2,741,278 | 4/1956 | McMurtrie | 83/708 |
| 3,339,317 | 9/1967 | Cleland | 51/92 R X |
| 3,716,948 | 2/1973 | Stanaback | 51/165.87 X |

*Primary Examiner*—Othell M. Simpson
*Assistant Examiner*—Nicholas P. Godici
*Attorney, Agent, or Firm*—Craig & Antonelli

[57] ABSTRACT

An apparatus for cutting off cast parts from a cylindrical runner of a casting body comprises a slidable mount supported on a bed, holding means provided on the slidable mount for supporting and indexing the casting body and a cutting grinder supported up and down movably on the bed. During a forward movement of the slidable mount in the axial direction of the casting body, cast parts arranged in an axial row are cut off successively. After this cutting, the casting body is indexed to the next cutting position and by a rearward movement of the slidable mount cast parts arranged in the next axial row are cut off. Thus cast parts on the outer periphery of the cylindrical runner of the casting body which usually is manufactured by precision casting may be cut off from the runner in the most simple and efficient way.

1 Claim, 6 Drawing Figures

APPARATUS FOR CUTTING OFF CAST PARTS FROM A RUNNER OF A CASTING BODY

This invention relates to a cutting apparatus for a casting body and particularly to a cutting apparatus for cutting gates of a casting body which has a cylindrical or pole-like runner and a plurality of cast parts arranged regularly on and connected to the outer periphery of the runner by the gates, to cut off the cast parts from the runner.

There has been molded such a casting body that has a cylindrical or pole-like runner and a plurality of cast parts arranged regularly on and connected to the outer periphery of the runner through gates by using commonly a precision casting method. After molding the casting body, each cast part should be cut off from the runner by cutting the associated gate. Conventional methods for cutting off the cast parts from the runner were manual. The cutting operation in the conventional method has been performed in the manner that the operator manually holds a casting body and pushes it against a cutting grinder which is always rotating or he holds and pushes a cutting grinder against a stationary casting body to make a desired cutting. This, however required one operator for a single cutting machine and therefore resulted in inefficiency and unsafety during operation. Also, there were the drawbacks that may cause heavy injuries on the operator's body with scattering metal or grinding powders during the cutting operation.

An object of the present invention is to provide an automatic or manual cutting apparatus wherein a casting body is held by holding means carried on a slidable mount, moved by the slidable mount in one longitudinal or axial direction of the casting body, during the movement of the casting body cast parts arranged in a first axial row being off by a cutting grinder, then rotated for one circular pitch by the holding means and thereafter moved in the opposite longitudinal direction of the casting body so as to cut off cast parts in a second axial row.

The cutting apparatus of the present invention is capable of performing any operation for cutting off cast parts from a runner of a casting body, keeping the casting body securely held in the holding means so that an excellent increase in working efficiency and safety in cutting operation may be obtained.

The term, "casting body" used in the present application means all casting products that have a runner of a cylindrical or pole-like form, gates and cast parts which are arranged regularly on the outer periphery of the runner.

An embodiment of the invention will now be illustrated by way of example with reference to the accompanying drawings, in which.

Figure 1:
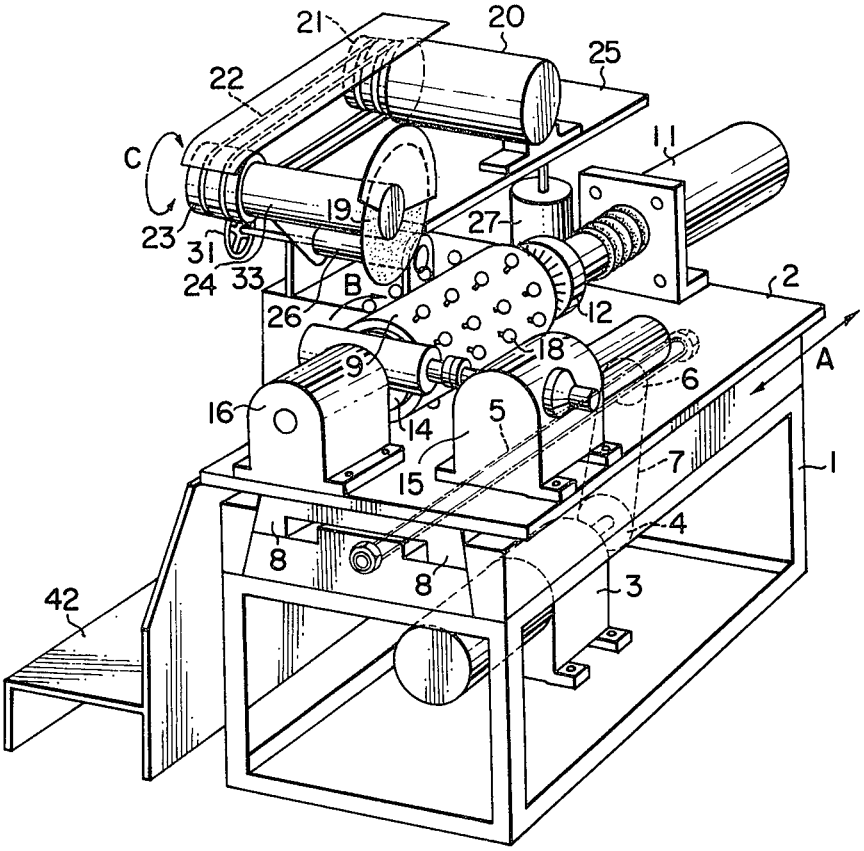
FIG. 1 is a perspective view-shown diagrammatically of the embodiment according to the invention.

Through FIGS. 1 – 6, an embodiment of the present invention is schematically shown. In FIG. 1, a bed 1 is fixed on a base. A slidable mount 2 is held in position movably on the bed 1. The slidable mount 2 has dovetails 8 on both sides on the lower surface of the mount 2, which dovetails engage with the upper surface of the bed 1 and restrict the movement of the mount 2 in the transverse direction. On the upper surface of bed 1 is rotatably provided a feed screw 5 engaging with a female screw formed on the slidable mount 2. The feed screw 5 has a follower chain wheel 6 secured thereto and connected to a chain wheel 4 fixed to a drive motor 3 on the bed 1 through a roller-chain 7. The drive motor 3 is a reversible motor so that the feed screw 5 may be rotated both in normal and reverse directions. The rotation of the motor 3 causes the slidable mount 2 to slidably move in the forward and rearward directions as shown by arrow A. There are provided two limit switches 37 and 38 on the bed 1 while a rod or an actuator 39 is provided on the lower surface of the slidable mount 2 so as to operate the limit switches 37 and 38 by movement of the mount 2. The limit switches may detect the terminal positions of the movement of the slidable mount 2 and are adapted to stop the rotation of the drive motor 3 with signals thereof. Preferably the limit switches 37 and 38 may be spaced at an interval larger than the entire length of a casting body 9 on the slidable mount 2.

Figure 2:
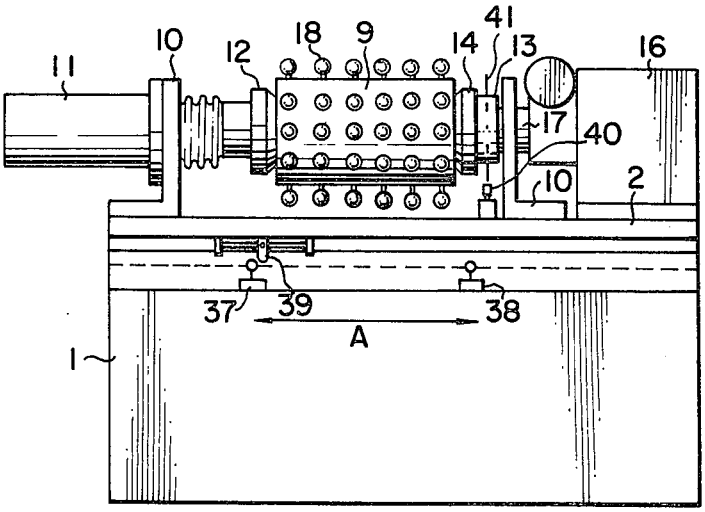
FIG. 2 is a side elevation of holding means of the embodiment according to the invention.
Figure 5:
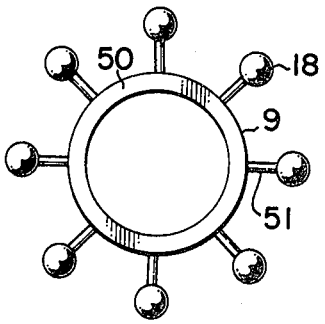
FIG. 5 is a plan view of a casting body.

As shown in FIG. 2, a holding means for the casting body 9 is fixed at the upper portion of the slidable mount 2. The holding means includes a holding plate 14 for carrying an end of the casting body 9 and a holding plate 12 for supporting the opposite end of the casting body 9. The holding plate 14 is rotatably held on a support 10 and connected to a rotary shaft 17 of a variable speed reduction means 16. Furthermore, the holding plate 14 is provided with an indexing disk 13, which is provided with a plurality of rods or actuators 41 in the radial direction. A limit switch 40 is fixedly provided on the slidable mount 2 below the indexing disk 13 so as to engage with the actuators 41. The actuators 41 are located corresponding to axial rows of cast parts 18 arranged on an outer periphery of a runner 50 (as shown in FIG. 5) in the casting body 9.

As shown in FIG. 1, a motor 15 is fixed on the mount 2, the motor 15 being connected to the variable speed reduction means 16 so that by rotation of the motor 15 the casting body 9 is rotated. The limit switch 40 is then connected through a controlling device (not shown) to the motor 15 and arranged to stop the motor 15 when the actuator 41 of the indexing disk 13 engages with the limit switch 40. Thus, the motor is urged to stop after the casting body 9 is rotated to a predetermined position. On the other hand, the holding plate 12 is mounted on a piston rod of an air cylinder 11 secured to a support 10 so as to move in the axial direction. The holding plate 12 also is mounted rotatably on the piston rod of the air cylinder 11.

Figure 3:
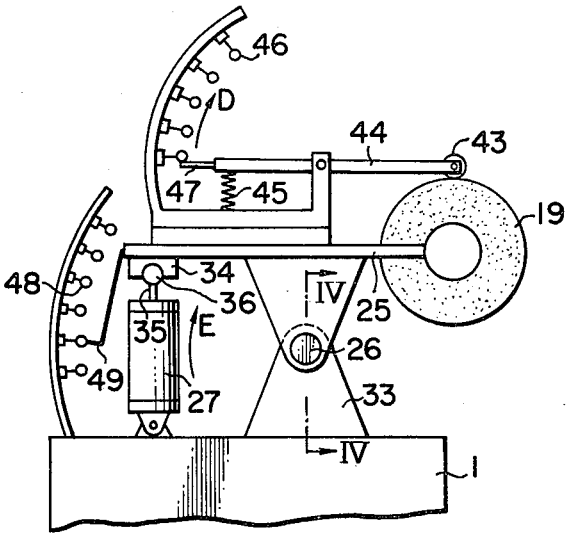
FIG. 3 is a partial view of a device for adjusting the cutting grinder.
Figure 4:
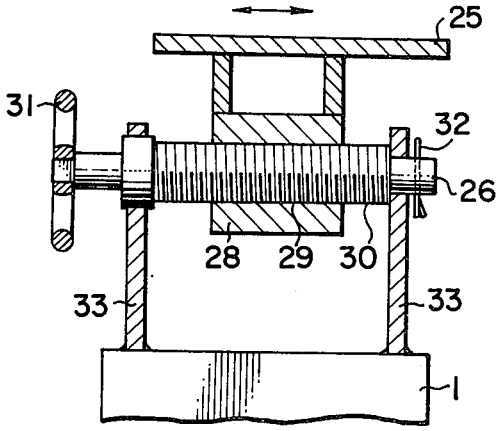
FIG. 4 is a view taken along the line IV — IV of FIG. 3.

The cutting means will be now detailedly illustrated. A rotating grinder 19 is rotatably mounted on a grinder table 25 and connected through a V-pulley 21, a V-belt 22 and a V-pulley 23 to a drive motor 20 fixed on the grinder table 25. The cutting grinder 19 is arranged in parallel with an axis of the casting body 9 and therefore in a plan view the axis of rotation of the cutting grinder 19 is normal to the center line of the casting body 9. As shown in FIGS. 3 and 4, the grinder table 25 having thereon the cutting grinder 19 is carried on a rotary shaft 26 which is rotatably supported by support plates 33 fixed on the bed 1 so that the table 25 may swing about the rotary shaft 26. The rotary shaft 26 is arranged in parallel with the axis of rotation of the cutting grinder 19. In order to adjust and fix the grinder table 25 in a desired position, an air cylinder 27 is provided between the bed 1 and the grinder table 25, which air cylinder 27 serves to provide a position for the cutting grinder 19 relative to the casting body 9 by upwardly or downwardly moving the cutting grinder 19 when the cutting operation of the grinder starts.

As shown in FIG. 4, there are provided a male screw 29 and a female screw 30 respectively on hinge portions 28 of the rotary shaft 26 and the grinder table 25. By rotating a wheel 31 at an end of the shaft 26, the grinder table 25 can be displaced to left and right in the arrow direction and then the cutting grinder 9 can be moved corresponding to the variable diameter of the casting body 9. In the figure, numeral 32 denotes a lock pin which prevents the rotary shaft 26 from moving off the support plate 33. As seen in FIG. 3, at the connecting part of the air cylinder 27 and the grinder table 25 are provided a ball member 36 secured to a rod 35 of the air cylinder 27 and a holder 34 fixed on the grinder table 25 and having a groove of a circular crossection for engaging with the ball member 36. This ball member 36 and the holder 34 permit the movement of the grinder table 25 in the axial direction of the rotary shaft 26 and the swing movement of the grinder table.

The above described device further includes means to prevent the cutting grinder 19 from becoming unable to cut off the material due to the wear of the grinder 19 during the cutting operation. As shown in FIG. 3, a roller 43 provided at one end of a swingable lever 44, which roller 43 is always lightly contacting to the outer periphery of the cutting grinder 19 by means of a coil spring 45. At other end of the lever 44 is provided a rod or an actuator 47, along a locus of which are arranged a plurality of limit switches 46 in annular form and spaced a certain distance from each other. These limit switches 46 are fixed to the grinder table 25. Accordingly, as the lever 44 moves in the arrow D direction depending on the wear of the cutting grinder 19, the position of the lever is detected by the limit switch 46. The grinder table 25 has at an end a rod or an actuator 49 and a plurality of limit switches 48 are arranged along a locus of the actuator 49. The limit switches 48 are fixed in the bed 1 and hence detect the position of the grinder table 25. Signals issued from the limit switches 46 and 48 are transmitted through controlling means (not shown) to solenoid valves which control the air cylinder 27 so as to position the cutting grinder 19 in a better cutting position. That is, with the progress of wear in the cutting grinder 19, the lever 44 will move in the D direction and, when the amount of wear reaches a limit that the grinder cannot cut off the cast parts anymore, the actuator 47 would contact one of the limit switches 46. In response to the signal of the limit switch 46, the air cylinder 27 may operate, so that the rod 35 rises and the cutting grinder 19 comes down. When the cutting grinder 19 comes down to a position sufficient to permit the cutting grinder 19 to cut off the cast parts 18 with much allowance, the actuator 49 moving with the grinder table 25 contacts one of the limit switches 48, by the signal of which the air cylinder 27 stops the operation thereof. Thus, the grinder 19 is automatically maintained always in a position permitting the grinder to make a cutting operation. For illustrative purpose only, the drawing shows the limit switches 46 and 48 having an enlarged space between each other.

Figure 6:
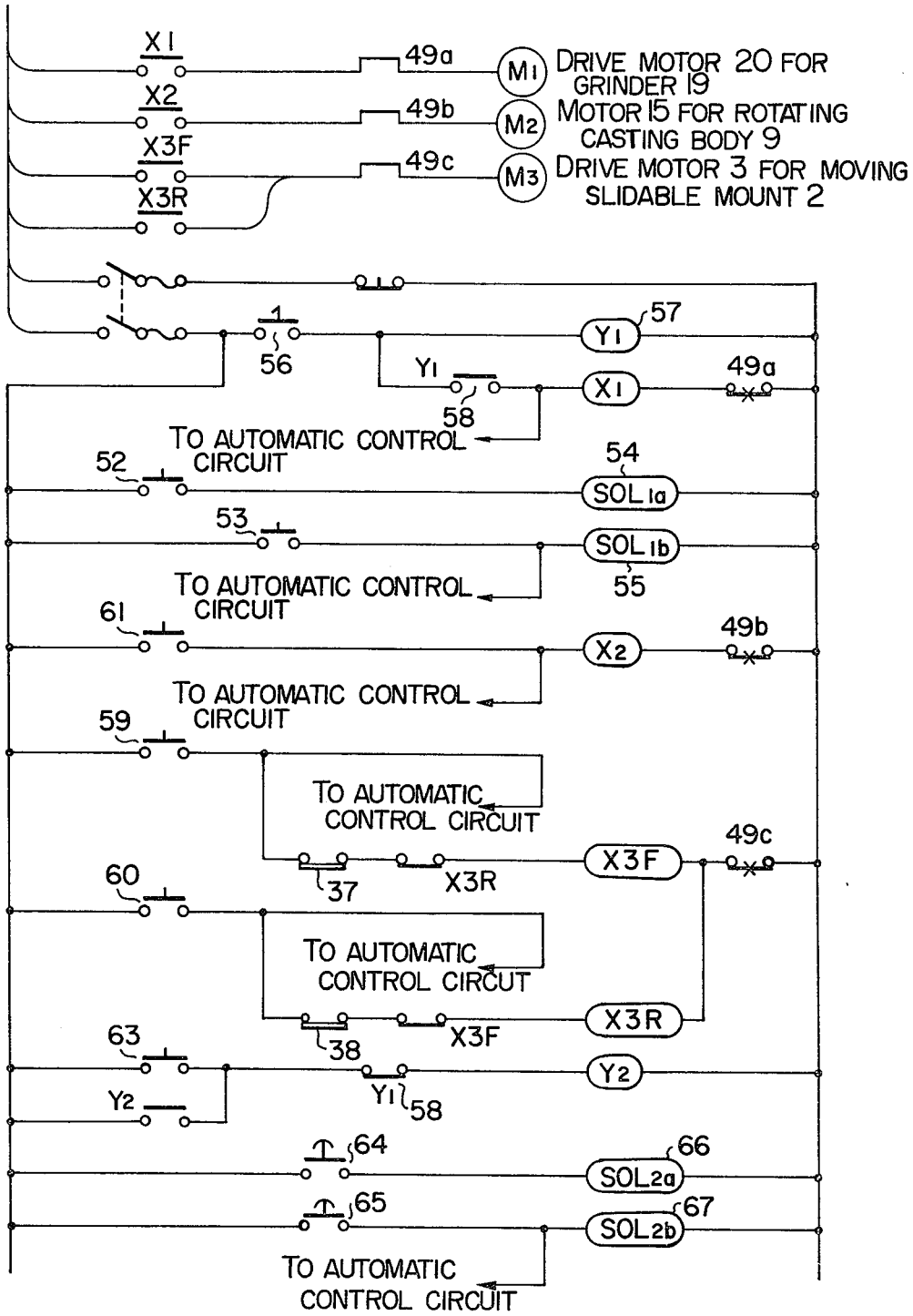
FIG. 6 is a part of an electrical circuit for a manual operation.

Operation of the cutting apparatus according to the invention will be illustrated below. The motors 3, 15, and 20 and air cylinders 11 and 27 are connected to a controlling device (not shown) so that they can be operated both automatically and manually. A circuit for manual operation is shown in FIG. 6. A circuit for automatic operation may be easily designed by the man skilled in the arts so as to be able to realize the later described automatic operation, the details of the circuit therefore being omitted.

1. MANUAL OPERATION

Assume that the slidable mount 2 in FIG. 2 is stopped at a left limit position.

Referring to FIG. 6 now, a foot-operated switch 65 is actuated to operate a solenoid valve **2*b* 67 which is connected with the air cylinder 11, so that the holding plate 12 held by the air cylinder 11 is receded. Holding the casting body 9 between the holding plates 12 and 14, a foot-operated switch 64 is actuated to excite a solenoid valve 2*a* 66 which is also connected with the air cylinder, so that holding plate 12 moves forwardly by the air cylinder 11 and catch the casting body securely between the holding plates 12 and 14. Then, push-button switches 52 and 53 are switched ON or OFF in order to set up the cutting grinder 19. The switches 52 and 53 energize solenoid valves 54 and 55 which, in turn, control the air cylinder 27 so as to move the grinder table 25 up and down. The cutting grinder 19 in set in the vertical direction to such a position that when the casting body 9 moves in the longitudinal direction the grinder 19 can cut the gates 51 of the body 9 by operating the push-button switches 52 and 53. In addition, if desired, the grinder 19 may be adjusted in the horizontal direction or in the axial direction thereof by rotating the shaft 26. In this time, the cutting grinder 19 is positioned in the right end of the casting body 9 shown in FIG. 2. Thereafter a lever switch 61 is actuated to excite the motor 15 and to rotate the casting body 9 until a first axial row of cast parts 18 reaches a predetermined cutting position. After a first axial row of cast parts 18 of the casting body 9 has reached the predetermined cutting position, the lever switch 61 is turned off and the casting body 9 is held in the position. Thus indexing of the casting body 9 is completed. Then, a push-button switch 56 is operated to drive the motor 20 for the cutting grinder and by actuating a lever switch 60, the drive motor 3 is now operated to move the slidable mount 2 forwardly, that is, in the right direction on FIG. 2. During the movement of the slidable mount 2 and the casting body 9, the gates of the cast parts arranged in the first axial row are cut successively by the rotating cutting grinder 19 and the cast parts are cut off from the runner 50. The cast parts having been cut off drop into a chute 42 (shown in FIG. 1) and are collected. After the cast parts 18 in the first axial row have been cut off by the rotating cutting grinder, the actuator 39 in the lower surface of the slidable mount 2 contacts the limit switch 38 to stop the rotation of the motor 3. Again, the lever switch 61 is actuated so as to rotate the casting body 9 for one circular pitch of the cast parts 18. Through the lever switch 59, the drive motor 3 is reversely rotated to backwardly move the slidable mount 2 in the left direction on FIG. 2 so as to cut off the cast parts 18 in the second axial row. The above described backward movement of the slidable mount is carried out until the actuator 39 contacts the limit switch 37. In the same way as described, the cast parts 18 may be cut off from the runner 50 and collected into the chute 42. The cutting method as above described solely concern with the successive cutting of the cast parts in the axial direction of the casting body 9. However, if desired, successive cutting of the cast parts in the circular direction may be done. For example, one cast part arranged at an end portion of the casting body 9 is first cut off by axial movement of the casting body 9, then the casting body 9 is rotated for one circular pitch, the next cast part arranged in the circular direction is cut off, then further the casting body 9** is rotated for one circular pitch and so on.

2. AUTOMATIC OPERATION

In the similar way as in the manual operation, the casting body 9 is held between the holding plates 12 and 14 and the position of the cutting grinder 19 is thus set up. At this moment, the axial rows of the cast parts 18 of the casting body 9 are adjusted so as to align with the actuators 41 of the indexing disk 13. The electric circuit may be changed over to an automatic cutting circuit and the switch is set ON. The slidable mount 2 is then moved to the right on FIG. 2 and accordingly the casting body on the slidable mount 2 moves forwardly thereby effecting the cutting separation of the cast parts 18 in the first axial row. When the actuator 39 of the slidable mount 2 contacts the limit switch 38 on the bed 1, the slidable mount 2 stops by receiving the signal from the limit switch 38. At the same time, receiving the signal from the limit switch 38, the motor 15 starts to rotate and the casting body 9 starts rotation. When the cast parts in the second axial row comes to the cutting position, the actuator 41 on the outer periphery of the indexing disk 13 corresponding to the cast parts in the second row contacts the limit switch 40. The motor 15 receiving the signal from the limit switch 40 stops and then the rotation of the casting body 9 stops and therefore the indexing of the casting body is completed. Also, by receiving the signal from the limit switch 40, a timer (not shown) actuates and after a certain period of time, a backward start switch (not shown) for the slidable mount 2 is turned on to start the backward movement of the slidable mount 2. Therefore, cutting of the cast parts 18 in the second axial row is accomplished. After the cutting has been completed the actuator 39 contacts the limit switch 37, the movement of the slidable mount 2 is stopped, and the casting body 9 again rotates so that the cast parts in the third axial row may be indexed in the cutting position. Similar cycles of operation may thus be repeated successively making automatic cutting separation of the cast parts. When the cutting grinder 19 wears out during the automatic cutting operation, the limit switch 46 as shown in FIG. 3 may detect the wear, operating the air cylinder 27, and urge the cutting grinder 19 to come down corresponding to the wear, so that a good cutting operation is assured always. In this manner, the cast parts on the outer periphery of the runner 50 in the casting body 9 are surely cut off at a part of the gate 51 being given no damage.

In the above embodiment, the air cylinders have been used, but any other cylinders also may be used or certain drive means using motors may be employed instead of the air cylinders.

As hereinbefore mentioned, according to the cutting apparatus of the embodiment, once the casting body has been set to the apparatus and the cutting grinder has been set up, the operator may not be required any operation or may be required only manual operations of switches until all cast parts are completely cut off. This effects a large increase in working efficiency. In addition, the injurious scattering of metal dusts on the operator's body is also avoided.

We claim:

1. In an apparatus for cutting off cast parts from an outer periphery of a runner of a casting body comprising a bed, slidable mount means reciprocally movable on said bed, drive means for reciprocally moving said slidable mount means, holding means provided on said slidable mount means for rotatably carrying said casting body, means including a cutting grinder located laterally of said casting body and substantially parallel to the axis of said casting body for cutting off the cast parts from the runner, said cutting grinder being adapted to move on a grinder table supported on said bed, said grinder table being swingable about a line substantially normal to the axis of said casting body in plan view, and fluid operable cylinder means connected to said grinder table and said bed for moving and fixing said grinder table, wherein the improvement comprises a swingable lever having at an end a roller contacting with an outer periphery of the cutting grinder and a first actuator at the opposite end, first limit switches arranged along a locus of movement of said first actuator and spaced apart from each other for a predetermined distance so that the first limit switches may be operated by said first actuator, a second actuator secured to said grinder table, and second limit switches arranged along a locus of movement of said second actuator and spaced apart from each other for a predetermined distance so that the second limit switches may be operated by said second actuator, said first limit switches being adapted to operate said cylinder means to move said cutting grinder, said second limit switches being adapted to stop the operation of said cylinder means.

* * * * *